US007575356B1

(12) United States Patent
Bouchard

(10) Patent No.: US 7,575,356 B1
(45) Date of Patent: Aug. 18, 2009

(54) BIRTHDAY CAKE COSTUME JEWELRY

(76) Inventor: Wanda J Bouchard, 464 John Street, Sault Ste. Marie, Ontario (CA) P6C 3K1

( * ) Notice: Subject to any disclaimer, the term of this patent is extended or adjusted under 35 U.S.C. 154(b) by 0 days.

(21) Appl. No.: 11/619,994

(22) Filed: Jan. 4, 2007

(51) Int. Cl.
*A44C 15/00* (2006.01)
*A44C 25/00* (2006.01)

(52) U.S. Cl. ..... 362/571; 362/565; 362/569

(58) Field of Classification Search ..... 362/551, 362/554, 555, 583, 565, 566, 569, 103, 104, 362/570, 571, 806, 810; 200/17 B, 1 B; 63/1.16, 63/1.17, 18, 20, 33
See application file for complete search history.

(56) References Cited

U.S. PATENT DOCUMENTS 3,681,588 A * 8/1972 Lee ..... 362/569
4,801,478 A * 1/1989 Greenblatt ..... 428/7
4,947,722 A * 8/1990 Lewis ..... 84/95.2
4,975,809 A * 12/1990 Ku ..... 362/605
5,558,421 A * 9/1996 Guastella ..... 362/565
5,902,972 A * 5/1999 Nestor et al. ..... 200/1 B
6,659,617 B1 * 12/2003 Michael ..... 362/104
6,776,508 B2 * 8/2004 Bucher et al. ..... 362/293
6,905,237 B2 * 6/2005 Jacobs et al. ..... 362/556
7,261,455 B2 * 8/2007 Schnuckle et al. ..... 362/569
2005/0018425 A1 * 1/2005 Lin ..... 362/252
2007/0025120 A1 * 2/2007 Lemay et al. ..... 362/565
2007/0068196 A1 * 3/2007 Seliktar ..... 63/37

* cited by examiner

*Primary Examiner*—Bao Q Truong
(74) *Attorney, Agent, or Firm*—Michael I Kroll

(57) ABSTRACT

An article of jewelry replicating a fancy birthday cake whereby a plurality of candle-like elements and respective illuminable member are combined with the tune "Happy Birthday" to form a happy birthday jewelry pendant that upon depressing the switch the lighting elements are illuminated and the audio clip is played. Additionally the lighting elements can vary in color using filters, colored illuminable elements, colored LEDs and/or candle-like tips of light diffusing materials of various colors.

4 Claims, 10 Drawing Sheets

BIRTHDAY CAKE COSTUME JEWELRY

BACKGROUND OF THE INVENTION

1. Field of the Invention

The present invention relates generally to jewelry and, more specifically, to a pendant having the form of a highly detailed and decorated birthday cake having five light responsive candles conducting a light source. Inside the body of the present invention a plurality of forms of light generation may be used typically either a single light with a plurality of fiberoptic cables or an LED type of system. Additionally integral to the present invention is a music producing element that may be activated along with said lighting via a small on/off switch located on the surface of the body.

2. Description of the Prior Art

There are other jewelry devices designed for presenting the form of a cake, while these elements of jewelry may be suitable for the purposes for which they were designed, they would not be as suitable for the purposes of the present invention, as hereinafter described.

SUMMARY OF THE PRESENT INVENTION

A primary object of the present invention is to provide an article of jewelry having the form of a birthday cake that generates audio and visual effects selectively operable through a switch.

Another object of the present invention is to provide an article of jewelry having an electronic circuit incorporating candle-like lighting elements and audio clip of the happy birthday tune.

Yet another object of the present invention is to provide an article of jewelry having fiberoptic pathways to illuminate the lighting elements.

Still yet another object of the present invention is to provide an article of jewelry wherein said lighting elements change color.

Another object of the present invention is to provide an article ofjewelry having color outputs determined by filters positioned within the light beam path.

Yet another object of the present invention is to provide an article of jewelry wherein said illuminable elements are a combination of fiberoptic cables and LEDs.

Still yet another object of the present invention is to provide an article of jewelry wherein the candle-like lighting elements have a translucent tip of varying color providing the color change difference between the lighting elements.

Another object of the present invention is to provide an article ofjewelry wherein said illuminable elements and said audio clip are operatively engaged through a switch.

The present invention overcomes the shortcomings of the prior art by providing an article ofjewelry replicating a fancy birthday cake whereby a plurality of candle-like elements and respective illuminable member are combined with the tune "Happy Birthday" to form a happy birthday jewelry pendant that upon depressing the switch the lighting elements are illuminated and the audio clip is played. Additionally the lighting elements can vary in color using filters, colored illuminable elements, colored LEDs and/or candle-like tips of light diffusing materials of various colors.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
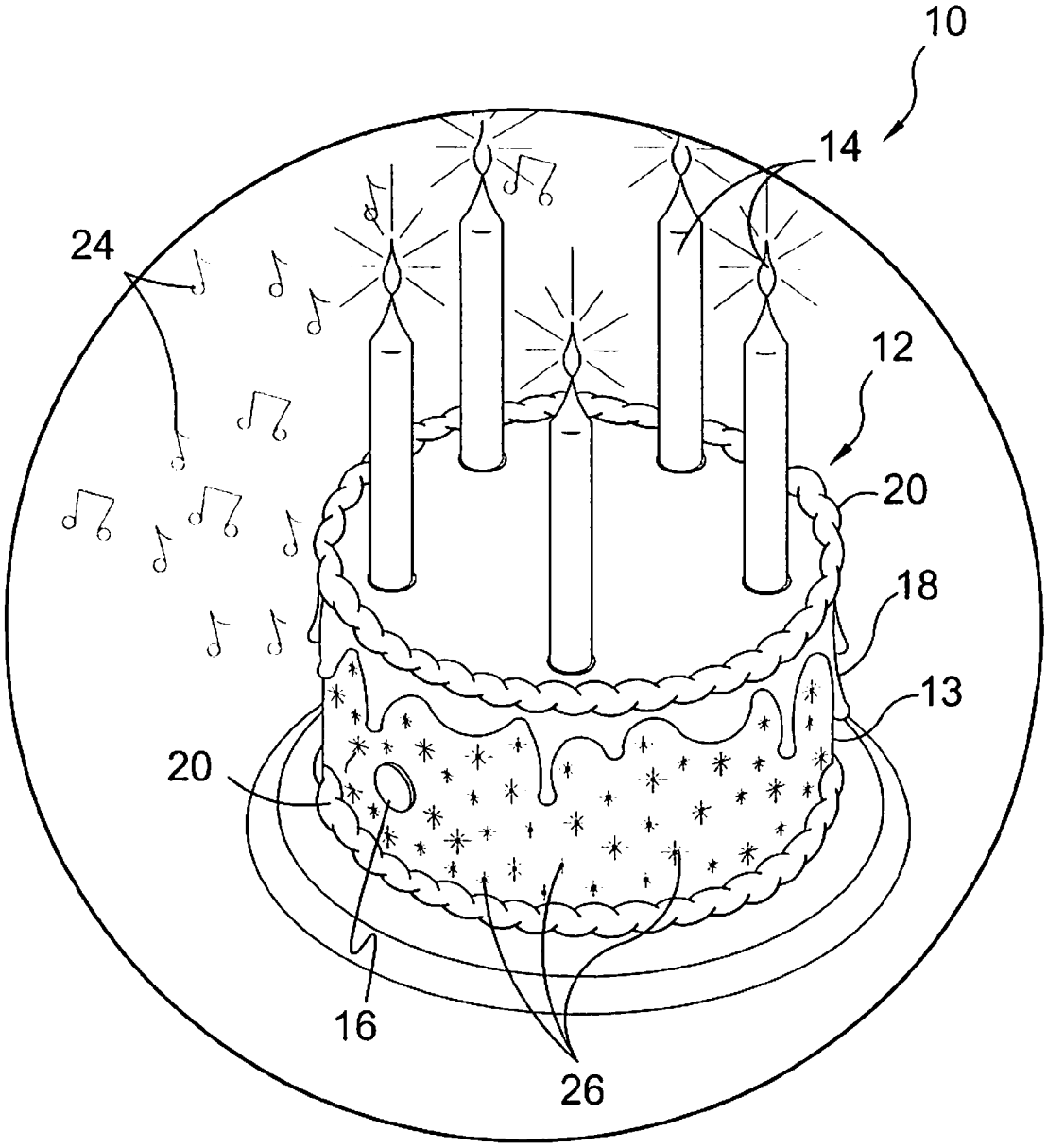
FIG. 1 is an illustrative view of the present invention in use.

Turning now descriptively to the drawings, in which similar reference characters denote similar elements throughout the several views, the figures illustrate the Birthday Cake Costume Jewelry of the present invention. With regard to the reference numerals used, the following numbering is used throughout the various drawing figures.

10 Birthday Cake Costume Jewelry of the present invention
12 birthday cake
13 cake body
14 illuminable candle
16 on/off switch
18 dripping icing
20 scalloped trimming
22 base of 12
24 music
26 diamond dust sparkles
28 wiring
30 light source
32 music box
34 battery
36 battery cover
38 fiber optics
40 LED lights
42 candle aperture
44 securing pin
46 color wheel

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10 in use. The present invention 10 is an article of jewelry presenting the form of an imitation birthday cake 12 having scalloped trimming 20 around the top and bottom rims of the cake body 13, dripping icing 18 effect, sparkles 26 and other decorations thereon. The cake includes a plurality of illuminable candles 14. A music box is provided to play "happy birthday" 24. The candles 14 and music box are activated when the on/off switch 16 is pressed. The device can also be provided with the use of LEDs that are battery powered.

Figure 2:
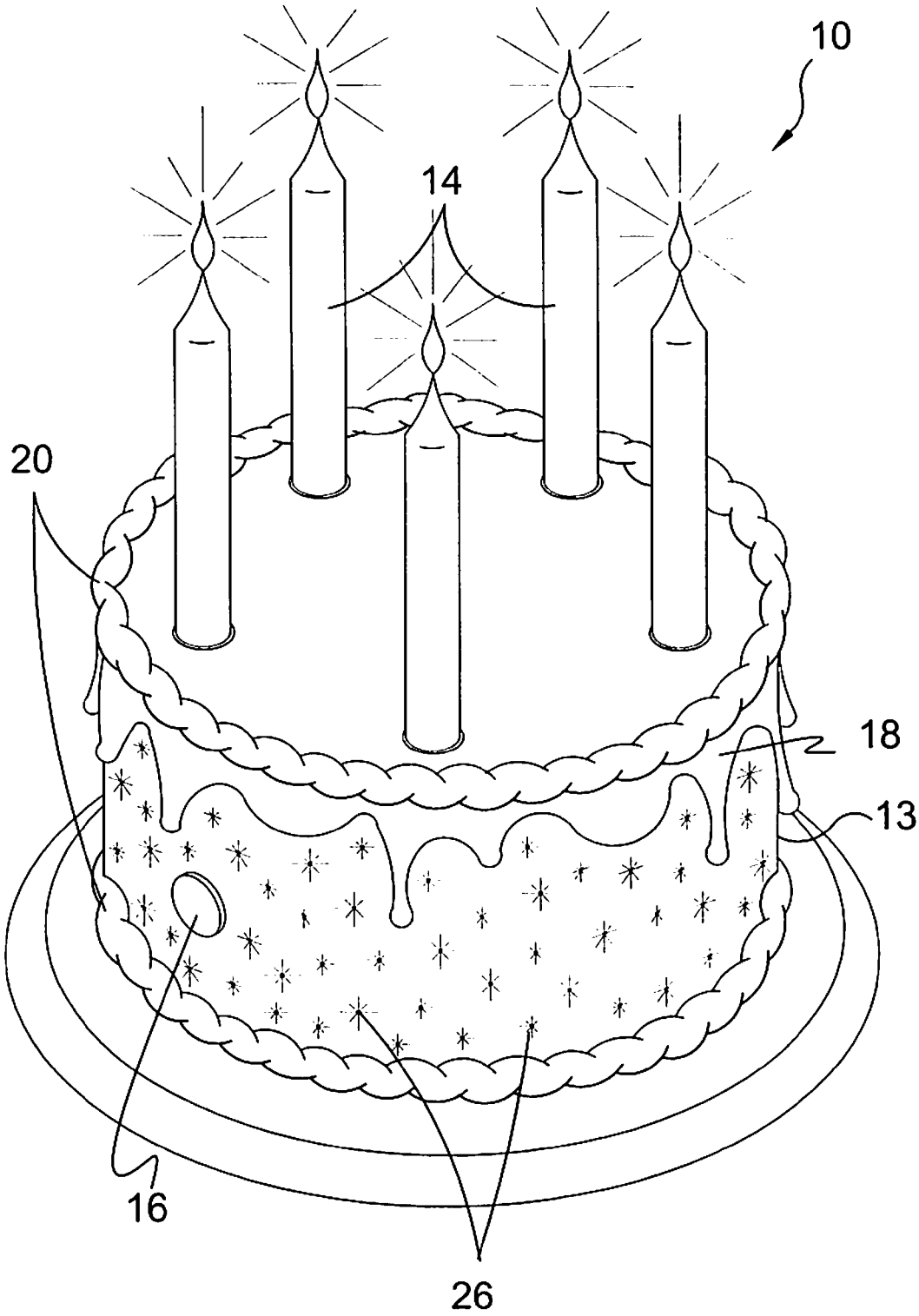
FIG. 2 is a perspective view of the present invention.

FIG. 2 is a perspective view of the present invention 10 in use. The present invention 10 is an article of jewelry presenting the form of an imitation birthday cake 12 having scalloped trimming 20 around the top and bottom rims of the cake body 13, dripping icing 18 effect, sparkles 26 and other decorations thereon. The cake includes a plurality of illuminable candles 14. The candles 14 and music box are activated when the on/off switch 16 is pressed.

Figure 3:
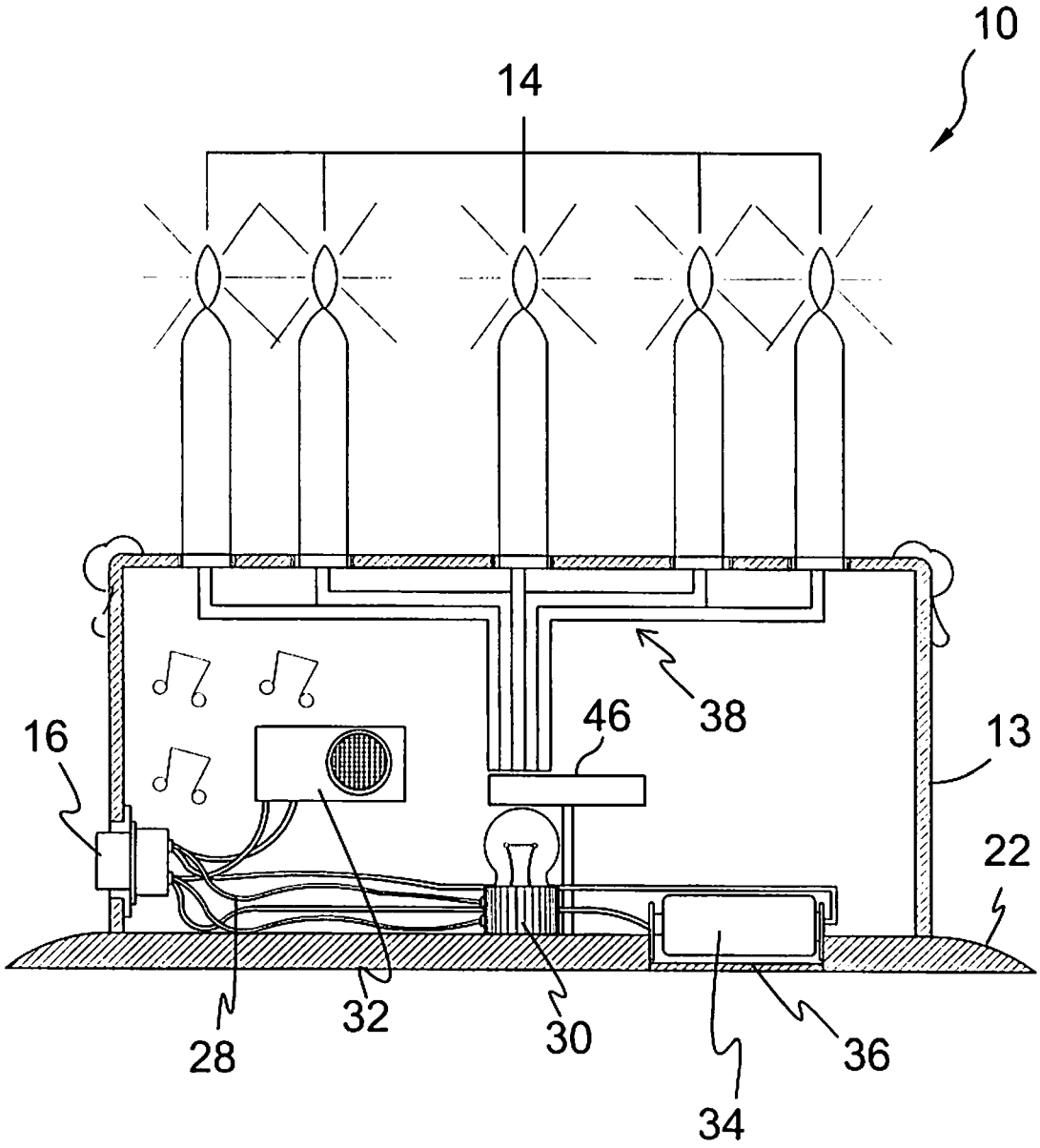
FIG. 3 is a sectional view of the present invention.

FIG. 3 is a sectional view of the present invention. Shown is a sectional view showing the internal components within the body 13. The on/off switch 16 is wired 28 to the battery 34, the music box 32 and the light source 30. Fiber optics 38 deliver light from the light source 30 to the illuminable candles 14. An optional color wheel 46 may also be provided to have the candles 14 rotate through a rainbow of colors while in use The battery 34 is accessible through a battery cover 36 disposed in the base 22.

Figure 4:
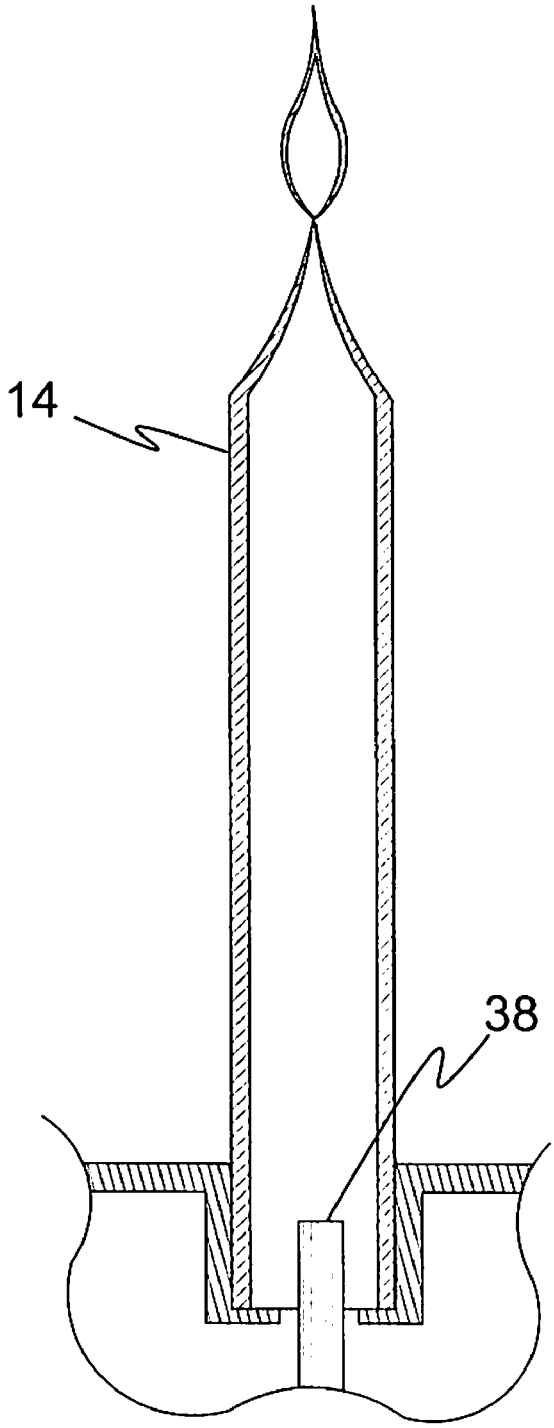
FIG. 4 is a sectional view of the candle of the present invention.

FIG. 4 is a sectional view of a candle 14 of the present invention. Each candle 14 is constructed of a clear hollow, colored tube that allows light to enter from a fiber optic 38 illuminating the candle 14 tube when the on/off switch is activated.

Figure 5:
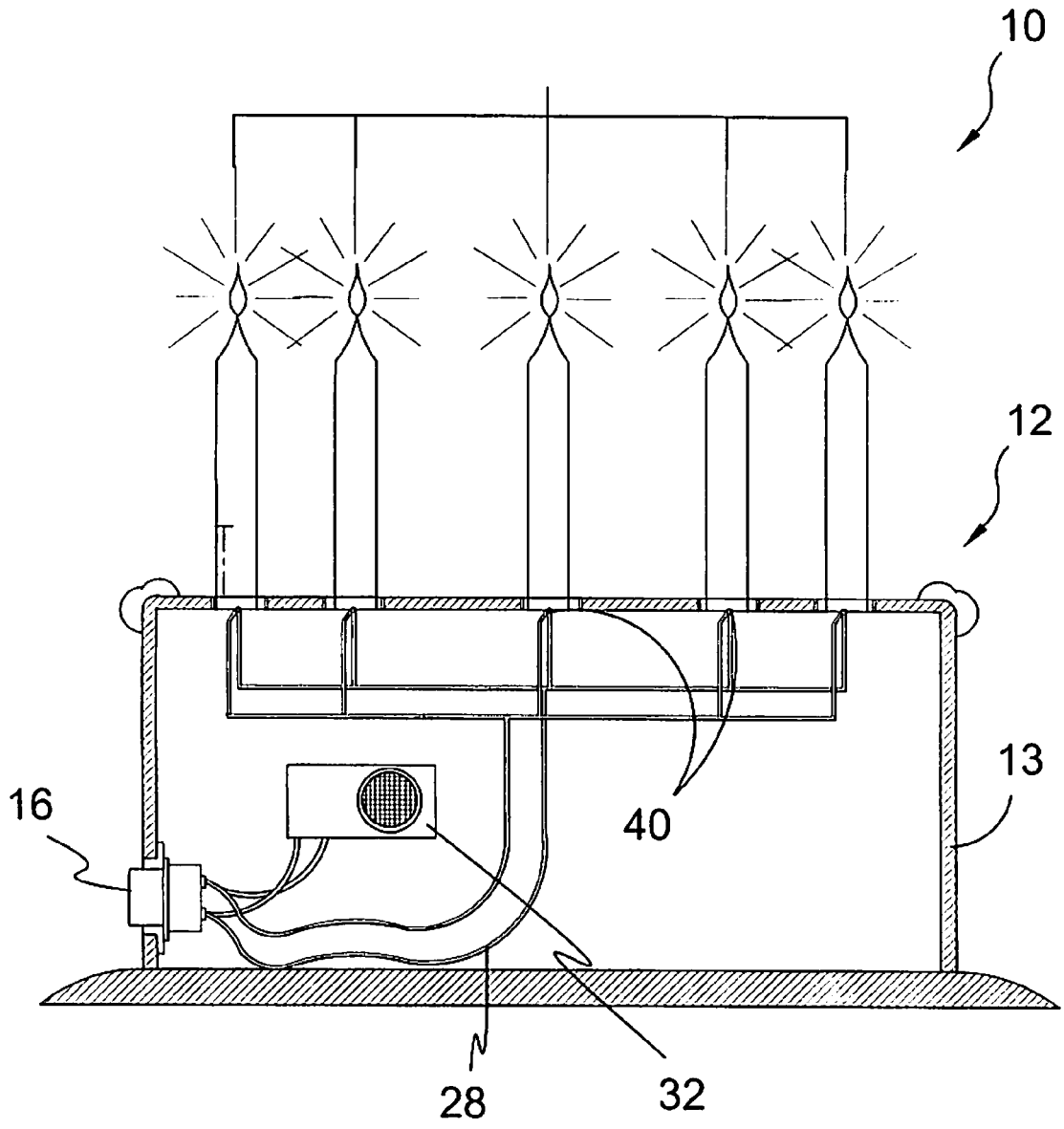
FIG. 5 is sectional view of the present invention.

FIG. 5 is a sectional view of the present invention 10. Shown is a sectional view showing the internal components within the body 13. The on/off switch 16 is wired 28 to the music box 32 and the light source which is a plurality of LED's 40 that deliver light to the illuminable candles 14.

Figure 6:
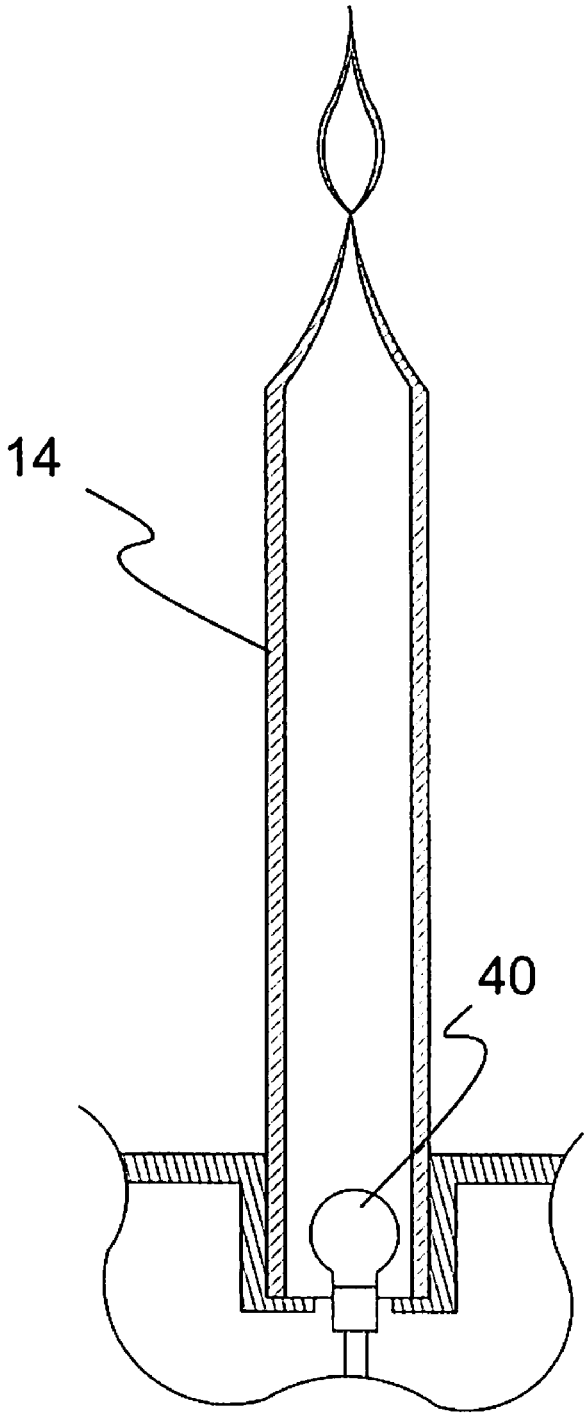
FIG. 6 is a sectional view of a candle of the present invention.

FIG. 6 is a sectional view of a candle 14 of the present invention. Each candle 14 is constructed of a clear hollow, colored tube that allows light to enter from an LED 40 illuminating the candle 14 tube when the on/off switch is activated.

Figure 7:
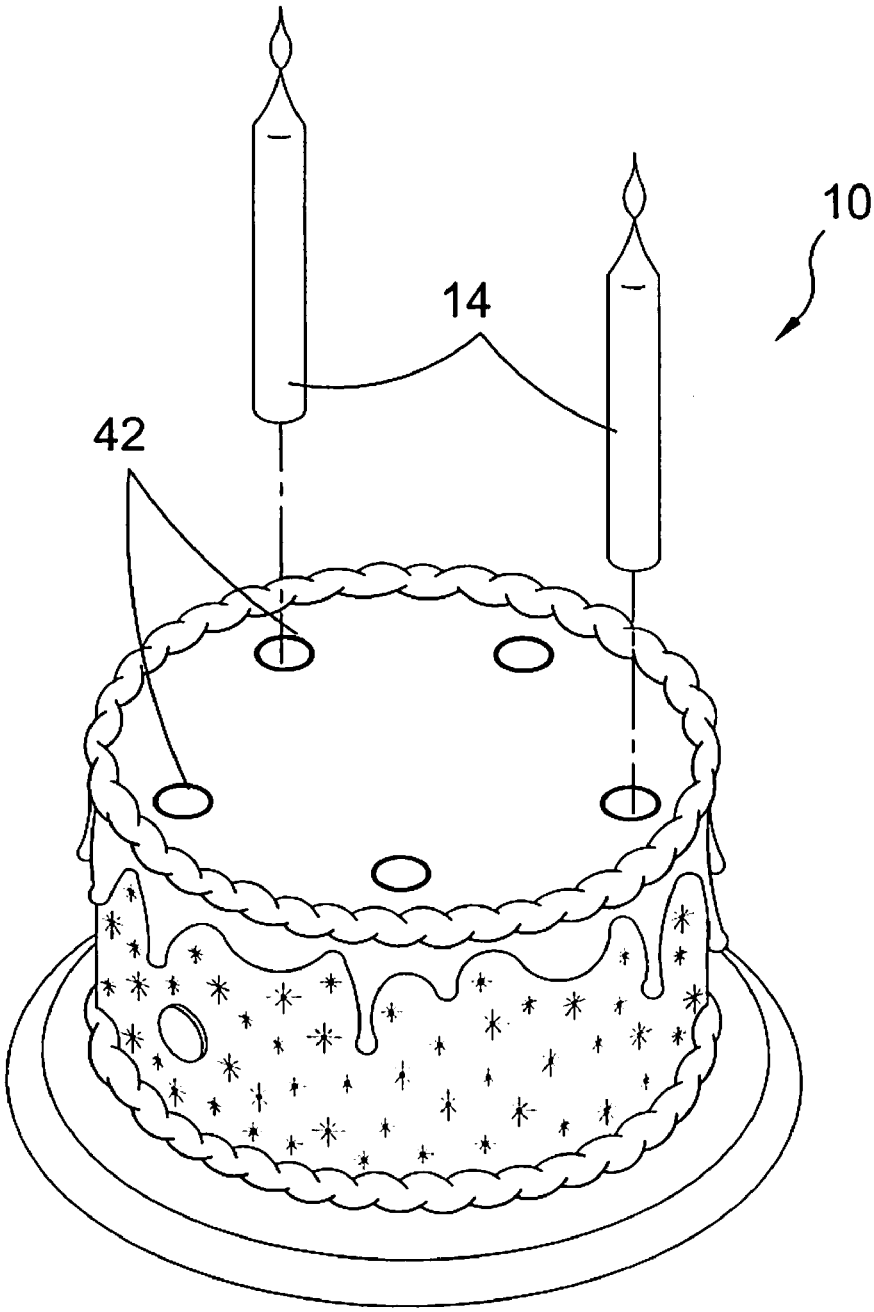
FIG. 7 is a perspective view of an alternate of the present invention.

FIG. 7 is a perspective view of the present invention 10 wherein the illuminable candles 14 are removably disposed in candle apertures 42.

Figure 8:
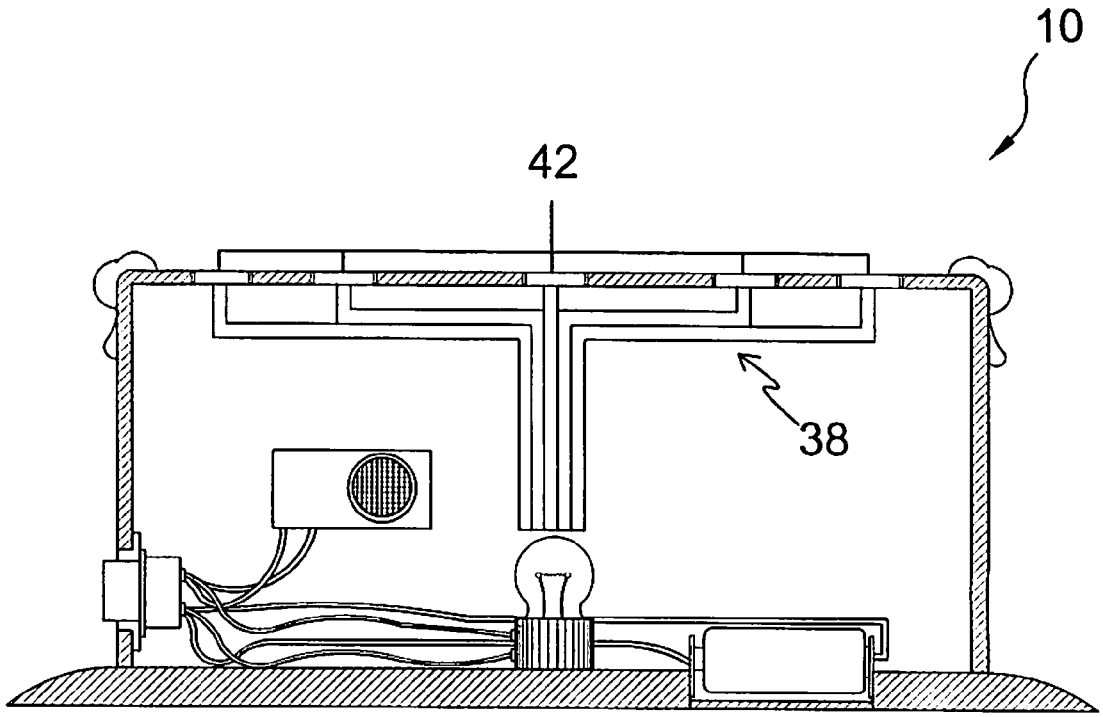
FIG. 8 is a sectional view of an alternate of the present invention.

FIG. 8 is a sectional view of the present invention 10 wherein the illuminable candles are removably disposed in candle apertures 42 and illuminated by fiber optic 38 lighting.

Figure 9:
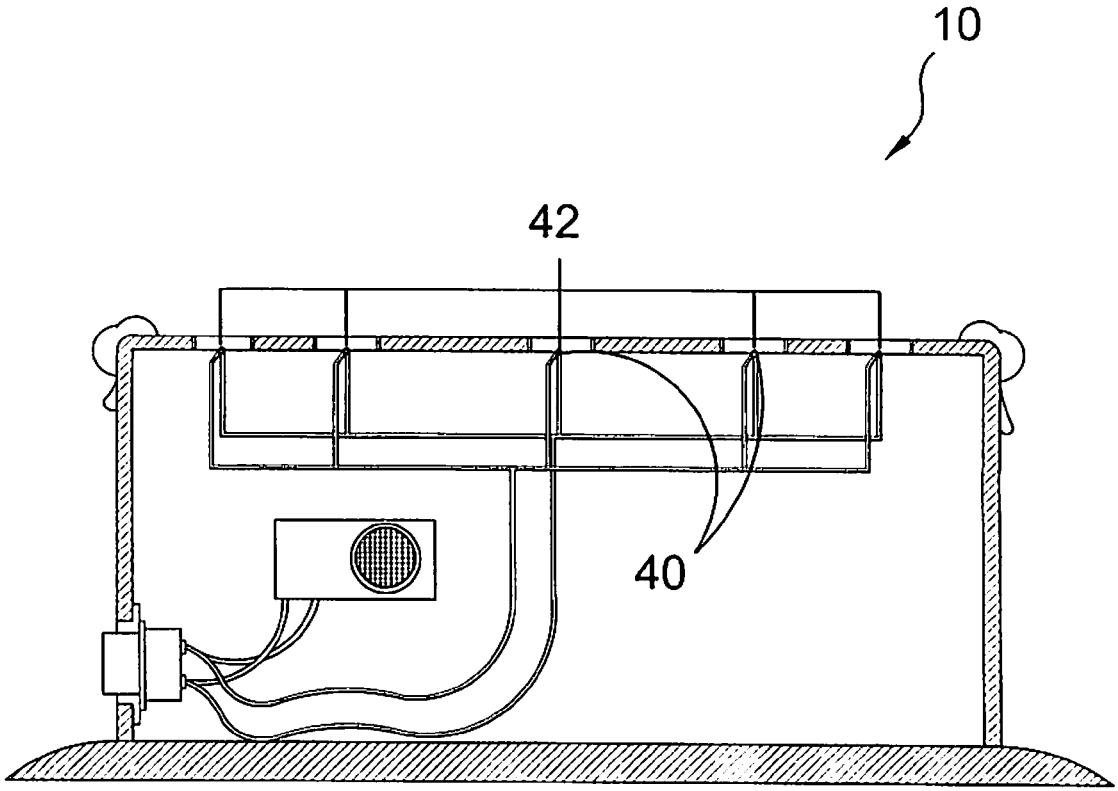
FIG. 9 is a sectional view of an alternate of the present invention.

FIG. 9 is a sectional view of the present invention 10 wherein the illuminable candles are removably disposed in candle apertures 42 and illuminated by LED 40 lighting.

Figure 10:
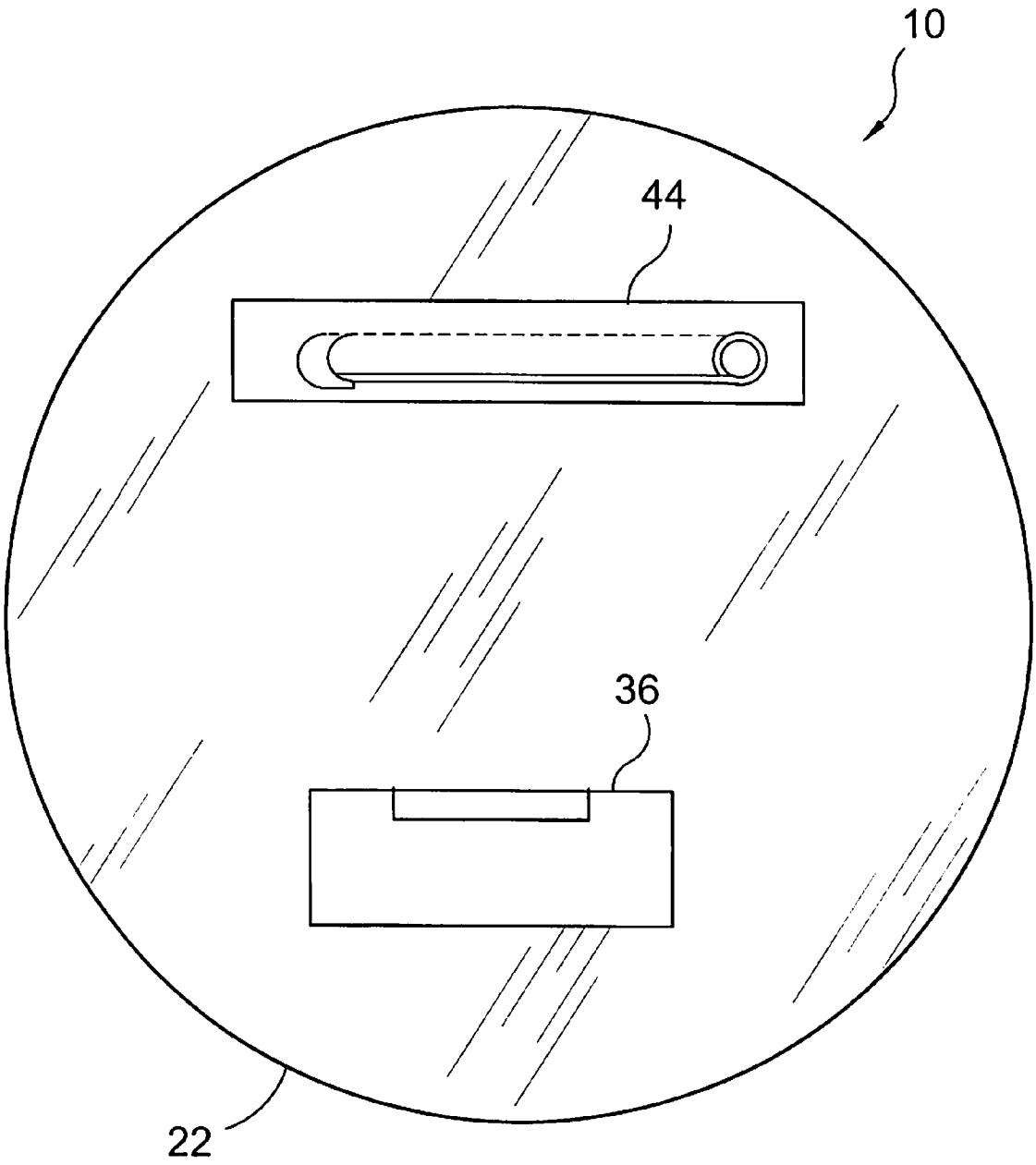
FIG. 10 is a bottom view of the present invention.

FIG. 10 is a bottom view of the present invention 10. Shown is the battery cover 36 and the securing pin 44. The securing pin 44 is recessed into the base 22 and pivotal to maintain a negative profile that will allow it to sit flat on a surface when not in use and fabricated of a sturdy metal material to enable the present invention 10 to be worn as a brooch.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention

What is claimed is new and desired to be protected by Letters Patent is set forth in the appended claims:

1. A piece of costume jewelry comprising:

a) a piece of jewelry comprising a body in the shape of a birthday cake comprising a flat upper wall, a flat bottom wall, and a circular outer wall joining said upper and bottom walls;

b) scalloped trimmings along top and bottom edges of said outer wall, dripping icing effect along an outer surface of said outer wall adjacent the top edge thereof, and sparkles along the outer surface of said outer wall, mimicking a birthday cake;

c) means attached to said bottom wall for allowing a user to wear said birthday cake as a piece of jewelry;

d) a plurality of single piece hollow translucent illuminable fake candles with a flame as part of each candle removably extending from a row of openings in said upper wall of said body;

e) fiber optic means within said body to deliver light to interiors of said candles through said openings in said upper wall for illuminating said illuminable candles, said fiber optic means comprising a light source mounted on said bottom wall, a plurality of optical fibers bundled together terminating above said light source, each optical fiber extending to a different one of said openings, and a rotating color wheel disposed between said light source and said terminated optical fibers to deliver a broad spectrum of changing colored lighting to said illuminable candles through said openings, support for said rotating color wheel extending from said rotating color wheel to said bottom wall;

f) a music box within said body; and e) an on/off switch on an outside surface of said outer wall connected to a battery recessed into said bottom wall to allow the user to selectively enable said illuminable candles and said music box, said on/off switch being a three-way switch that activates said light source to illuminate said candles upon a first depression thereof, activates said music box upon a second depression thereof, and disable both upon a third depression thereof thereby permitting the user to selectively wear the piece of costume jewelry with the candles illuminated without the music box disabled if so desired.

2. The costume jewelry recited in claim 1, wherein said music box plays a happy birthday song when activated by said on/off switch.

3. The costume jewelry recited in claim 2, wherein said bottom wall has a securing pin mounted in a recess on an outer surface thereof for attachment to an article of clothing whereby said costume jewelry can be worn as a brooch.

4. The costume jewelry recited in claim 3, wherein said sparkles are fabricated of diamond dust.

* * * * *